US007048503B2

(12) United States Patent
Döring et al.

(10) Patent No.: US 7,048,503 B2
(45) **Date of Patent: *May 23, 2006**

(54) EXHAUST-GAS TURBINE FOR TURBOCHARGERS

(75) Inventors: Volker Döring, Stuttgart (DE); Hans-Dieter Hensel, Vaihingen (DE); Peter Schlick, Esslingen (DE)

(73) Assignee: DaimlerChrysler AG., Stuttgart (DE)

( * ) Notice: Subject to any disclaimer, the term of this patent is extended or adjusted under 35 U.S.C. 154(b) by 363 days.

This patent is subject to a terminal disclaimer.

(21) Appl. No.: 10/616,523

(22) Filed: Jul. 10, 2003

(65) Prior Publication Data

US 2005/0008479 A1 Jan. 13, 2005

(30) Foreign Application Priority Data

Jul. 10, 2002 (DE) ..... 102 31 108

(51) Int. Cl.
*F01D 17/16* (2006.01)

(52) U.S. Cl. ..... 415/150; 415/158

(58) Field of Classification Search ..... 415/150, 415/157–158

See application file for complete search history.

(56) References Cited

U.S. PATENT DOCUMENTS

| | | | | |
|---|---|---|---|---|
| 2,739,782 | A | 3/1956 | White | |
| 4,656,834 | A * | 4/1987 | Elpern | 60/602 |
| 5,267,829 | A * | 12/1993 | Schmidt et al. | 415/48 |
| 6,374,611 | B1 * | 4/2002 | Doring et al. | 60/605.1 |
| 6,478,536 | B1 * | 11/2002 | Doring et al. | 415/158 |
| 6,810,666 | B1 * | 11/2004 | Lutz et al. | 60/602 |

FOREIGN PATENT DOCUMENTS

| | | |
|---|---|---|
| DE | 196 45 388 | 5/1998 |
| DE | 100 28 751 | 12/2001 |
| JP | 52-85059 | 2/1979 |

* cited by examiner

*Primary Examiner*—Edward K. Look
*Assistant Examiner*—Devin Hanan
(74) *Attorney, Agent, or Firm*—Klaus J. Bach

(57) ABSTRACT

In an exhaust gas turbine for a turbocharger of an internal combustion engine with a casing and a rotor rotatably supported in the casing, the casing includes an inlet duct with a guide vane structure supported so as to be movable into and out of a flow inlet area to the rotor by means of an electric motor.

4 Claims, 2 Drawing Sheets

EXHAUST-GAS TURBINE FOR TURBOCHARGERS

BACKGROUND OF THE INVENTION

The invention relates to an exhaust-gas turbine for a turbocharger of an internal combustion engine, including a turbine casing with a rotor rotatably supported therein, an inlet duct, and a guide vane structure movable into, and out of, an annular space surrounding the rotor, by means of an actuating device.

DE 196 45 388 A1 discloses an exhaust-gas turbine, in which a guide vane structure can be moved axially into an annular space between a spiral inlet duct and a radial rotor. This is done by an axial slide, which is integrally formed with the guide vane structure at one end face thereof and at the same time serves as a cover disc for the guide-vane structure. The axial slide is adjustable axially via a radially extending slide pin which is guided in an axial slot of a turbine casing. At its free end face, the guide-vane structure has a second cover disc which, in a retracted position of the guide-vane structure, in which the guide-vane structure is located in an annular gap between the turbine casing and an inner guide of the guide-vane structure, covers the annular gap and prevents exhaust gases from escaping in an uncontrolled manner via the annular gap. In the extended position, in which the guide-vane structure is located in the annular space, the axial slide closes the annular gap with the exception of a play necessary for adjustment movement.

Furthermore, DE 100 28 751 A1 discloses an exhaust-gas turbine including a guide-vane structure, which is limited axially by two cover discs. One cover disc has integrally formed on it an axial slide, which is guided at its free end in a slot by axially extending slide pins. The sliding pins project through the slot. To adjust the axial slide, a slide sleeve acts on the free end faces of the slide pins. In the retracted position of the guide-vane structure, the cover discs and that region of the axial slide which is adjacent to the inner cover disc close the annular gap. In the extended position, the annular gap is closed, with the exception of the play necessary for adjustment, by the inner cover disc and the adjacent region of the axial slide.

It is the object of the invention to provide an arrangement for the accurate adjustment of the guide-vane structure in a simple manner over the entire adjustment range.

SUMMARY OF THE INVENTION

In an exhaust gas turbine for a turbocharger of an internal combustion engine with a casing and a rotor rotatably supported in the casing, the casing includes an inlet duct with a guide vane structure supported so as to be movable into and out of a flow inlet area to the rotor by means of an electric motor.

With this arrangement, a continuous and also high-precision adjustment becomes possible and, in turn, an accurate control of the rotational speed of the engine is achieved.

To this end, the actuating device is preferably designed as an eccentric drive, which is drive-connected at the input side to the actuating device, and at the output side indirectly or directly to the slide sleeve.

The actuating device may also be in the form of an electrically operated servomotor.

The actuating device may further be a piston rod, which is connected in an articulated manner to the eccentric drive which, in turn, is connected to the slide sleeve.

Finally, in accordance with a preferred embodiment of the invention, the rotor of the exhaust-gas turbine may be mounted rotatably in a turbine casing having a spiral inlet duct followed by an annular space surrounding the rotor. Near the outer circumference of the rotor, in an axially offset annular gap between the turbine casing and an inner guide, a guide-vane structure is provided, which is firmly connected, at its one end face facing away from the annular space, to axially directed sliding pins extending through guide slots of the casing. The guide-vane structure can be moved axially into the annular space by means of a slide sleeve acting on the ends of the slide pins. The guide-vane structure has guide vanes disposed between two end-face cover discs. In the end position of the guide-vane structure in the annular space, the annular gap is closed by one cover disc, from which the slide pins extend as integral parts thereof. The slide with the axial slide sleeve is movably supported on the inner guide. Preferably, the associated actuating device consists of an actuating cylinder, which is designed as an electrically operable actuator and is connected via a connection part to the slide sleeve. The slide sleeve is mounted in the region of the outer circumference of a cylindrical inner part, which forms the inner guide and coaxially surrounds the outlet duct and is connected indirectly or directly to the guide vane structure.

The invention will become more readily apparent from the following description thereof on the basis of the accompanying drawing:

DESCRIPTION OF A PREFERRED EMBODIMENT

Figure 1:
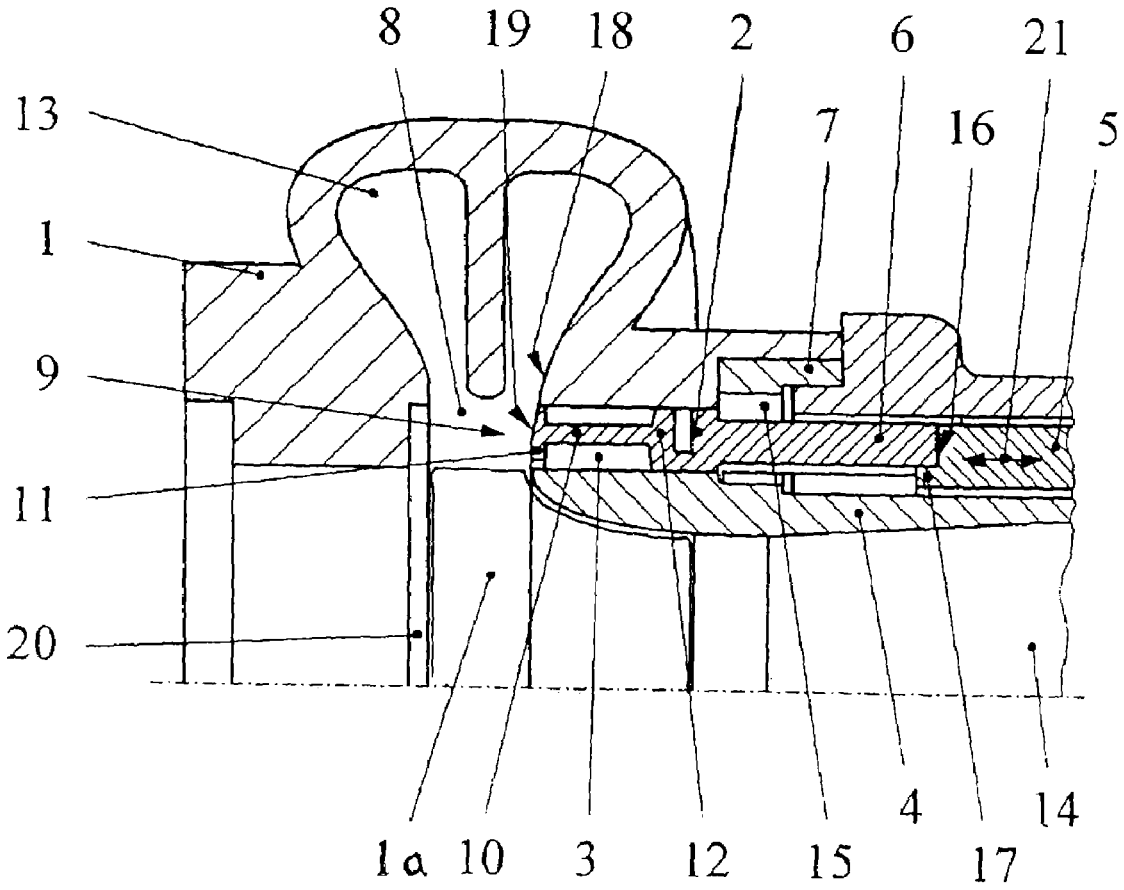
FIG. 1 is a partial sectional view of a casing of a gas turbine without a rotor, with a guide-vane structure in the retracted position.

A double-flow spiral inlet duct 13 is provided in a turbine casing 1 and leads to an annular space 8. The latter has adjacent to it, inwards in the radial direction, a radial rotor 1*a* of the exhaust-gas turbine, through which rotor the exhaust gases flow into an axially extending outlet duct 14. An annular axial slide member 2, which carries a guide-vane structure 9 with guide vanes 10, is provided in an annular gap 3 between the turbine casing 1 and an inner guide tube 4. The end faces of the guide vanes 10 are connected to one another by means of cover discs 11 and 12, of which the inner cover disc 12 is formed integrally with the axial slide member 2. The cover disc 12 forms, together with the adjacent region of the axial slide 2, a ring of rectangular cross section which is guided with slight play in the annular gap 3 and which prevents appreciable quantities of exhaust gas from escaping through the annular gap 3 when the guide-vane structure 9 is retracted to a disengaged position and is located in the annular space 8.

In the illustrated retracted position of the axial slide 2, a contour 19 of the cover disc 11 facing the annular space 8 is flush with the contour 18 of the inlet duct 13, so that, with the engine operating, the flow is not disturbed. Furthermore, the cover disc 11 additionally seals off the annular gap 3. The axial length of that part of the guide-vane structure 9 which is provided with the guide vanes 10 corresponds to the axial extent of the annular space 8.

At the end of the axial slide 2, which faces away from the guide-vane structure 9, a plurality of axially extending slide pins 6, which are integrally formed, with the slide 2 are distributed over the circumference. The pins 6 extend through recesses 15 in a guide slot member 7 so that the slide member 2 is guided with play in the guide slot member 7 transversely to the circumferential direction. Since sealing-off is no necessary at this point, the play can be relatively large for cost-effective manufacture. Moreover, this avoids a jamming of the axial slide 2 in the guide slot member 7, which is expediently an integral component of the inner guide tube 4. The free end faces of the slide pins 6 are connected to a slide sleeve 5 at a joint 16 in a materially integral manner, for example by hard soldering, welding or the like, preferably by laser welding. This expediently takes place when the axial slide 2 and the sliding sleeve 5 are mounted on the inner guide tube 4. In this case, they are aligned with one another and held by means of an inner centering edge 17 until they are firmly connected to one another. Moreover the centering edge 17 protects the region, radially on the inside with respect to the joint 16 between the axial slide member 2 and the slide sleeve 5, on the one hand, and the inner guide tube 4, on the other hand, against material particles which could emerge at the joint 16 during welding.

The slide sleeve 5 is adjusted, as required, in the adjustment direction 21 from the retracted position illustrated into an extended position, in which the guide-vane structure 9 is located in the annular space 8. In this position, the cover disc 11 is located in a recess 20 and is approximately flush with the contour 18 of the inlet duct 13 towards the guide vanes 10, so that the cover disc 11 does not disturb the flow through the annular space 8 and the exhaust gases are deflected solely by the guide vanes 10 which extend axially completely across the annular space 8.

Figure 2:
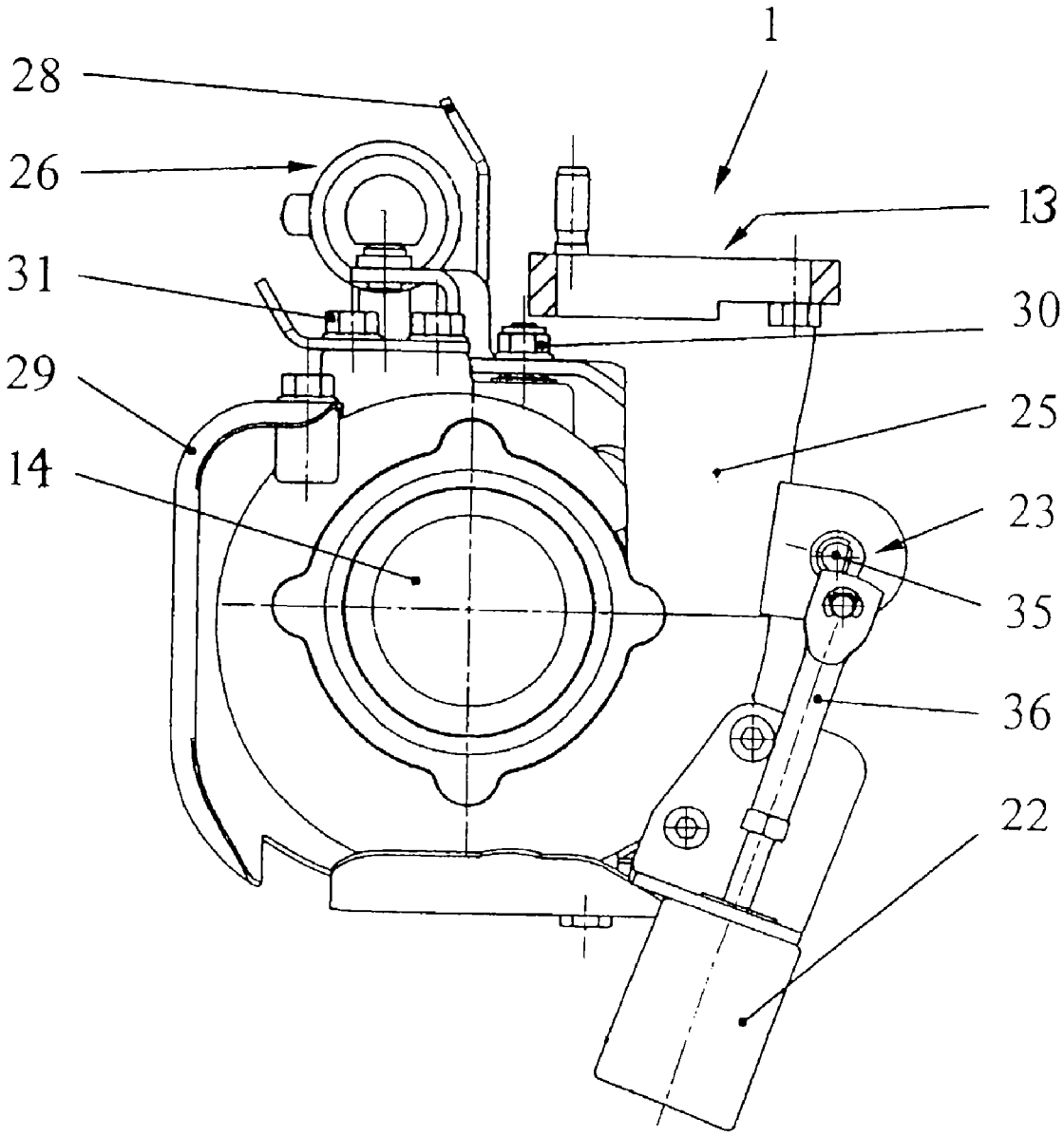
FIG. 2 shows the turbine casing of the exhaust-gas turbine with the pedal-operated motor, in a view from the front, according to FIG. 1.

FIG. 2 illustrates the exhaust-gas turbine for turbochargers in an axial view and shows the inlet duct 13 with an associated entry neck 25, which is connected to the inlet duct 13. An actuating cylinder 26 is located in the upper region of the turbine casing 1. At least two shielding plates 28 and 29 are fastened by means of screw bolts 30 and 31 to the turbine casing 1.

The slide sleeve identified by 5 in FIG. 1 is connected indirectly or directly to an actuating part, not illustrated in any more detail in the drawing, of an actuating device or of an eccentric drive 23 (FIG. 2). The eccentric drive 23 is drive-connected via a crank 35 to a piston rod 36 of the actuator or of the stepping motor 22. The eccentric drive 23 may be connected to the slide sleeve 5 and thus to the guide-vane structure 9 indirectly, for example, via a cam, which is not illustrated in the drawing, so that the guide vanes 10 illustrated in FIG. 1 can be displaced, for example, out of the retracted position into an extended operating position, not illustrated in the drawing, in which the guide-vane structure 9 is disposed in the annular space 8. A highly accurate control or adjustment of the guide-vane structure 9 is possible by means of the stepping motor 22.

What is claimed is:

1. An exhaust gas turbine for a turbocharger of an internal combustion engine, comprising a turbine casing (1) with an inlet duct (13), a rotor (1*a*) rotatably supported in said turbine casing (1), a guide vane structure (9) axially movably supported in said casing (1) so as to be movable axially into and out of an annular space (8) surrounding the rotor (1*a*), and an actuating device (23) arranged in the region of the outer circumference of the rotor for moving the guide vane structure (9), said actuating device (23) consisting of an operating member (21, 23), with an eccentric drive (23, 35) connected to an electrically operable actuator (22) via a connecting part (36), and to a slide sleeve (5), said slide sleeve (5) extending around a tubular inner member (4) which forms an axial outlet duct (14) and being connected to the guide-vane structure (9).

2. An exhaust-gas turbine according to claim 1, wherein the actuator (22) is an electrically operated stepping motor.

3. An exhaust-gas turbine according to claim 1, wherein the actuator (22) includes a rod (36) which is connected in an articulated manner to the eccentric drive (23) which, in turn, is connected to the slide sleeve (5).

4. An exhaust gas turbine comprising a turbine casing (1), a rotor (1*a*) mounted rotatably in the turbine casing (1), said turbine casing having a spiral inlet duct (13) followed by an annular space (8) disposed around the rotor (1*a*), said casing (1) including near the outer circumference of the rotor (1*a*) an axially extending annular gap (3) between the turbine casing (1) and an inner guide tube (4), a guide vane structure (9) having one end face facing away from the annular gap (3) and provided with axially extending slide pins (6) disposed in bores of said casing and being movable axially into the annular space (8), a slide sleeve (5) acting on the ends of the slide pins (6) for moving said pins (6), said guide vane structure (9) having guide vanes (10) extending between two end-face cover discs (11, 12), said guide vane structure (9) when disposed in the annular gap (3) closing the annular gap (3) with a cover disc (11), said slide pins (6) being joined to the slide sleeve (5) after the mounting of the slide sleeve (5) on the inner guide tube (4), and an actuating device in the form of an electrically operable actuating device (23) consisting of an operating member (21, 23) with an eccentric drive (23, 35) connected to an actuator (27) via a connecting part (36) and to a slide sleeve (5) extending around a tubular inner member (4) which forms an axial outlet duct (14) and being connected to the guide vane structure (9).

* * * * *